US005584092A

United States Patent [19]

Polzin et al.

[11] Patent Number: 5,584,092

[45] Date of Patent: Dec. 17, 1996

[54] ROLLER HAVING SLIP-ON CAGE FOR PAINT ROLLER COVER

[75] Inventors: Bruce C. Polzin, Greendale; Robert A. Shaffer, Kenosha; David L. Prins, Oak Creek; Rand J. Krikorian, Mequon; William W. Barton, Greendale, all of Wis.

[73] Assignee: Newell Operating Company, Freeport, Ill.

[21] Appl. No.: 383,878

[22] Filed: Feb. 6, 1995

[51] Int. Cl.[6] ..... B05C 17/02

[52] U.S. Cl. ..... 15/230.11; 492/13; 492/19; 492/45

[58] Field of Search ..... 15/230.11; 492/13, 492/14, 19, 45

[56] References Cited

U.S. PATENT DOCUMENTS

| | | | |
|---|---|---|---|
| 3,430,321 | 3/1969 | Lyons | 492/45 |
| 3,774,278 | 11/1973 | Ashton | 15/230.11 |
| 3,986,226 | 10/1976 | Roe et al. | 15/230.11 |
| 5,210,899 | 5/1993 | Goldtein et al. | 15/230.11 |

FOREIGN PATENT DOCUMENTS

| | | | |
|---|---|---|---|
| 2446136 | 9/1980 | France | 15/230.11 |
| 2558077 | 7/1985 | France | 15/230.11 |
| 778665 | 7/1957 | United Kingdom | 15/230.11 |

*Primary Examiner*—Mark Spisich
*Attorney, Agent, or Firm*—Baker & McKenzie

[57] ABSTRACT

A cage for a paint roller is composed as a one piece, unitary construction having a plurality of projections carried by a barrel portion of the cage, the projections making pressure contact with the inside of the bore in the center of the cover so as to prevent the cover from walking off the cage in use. The projections are formed to adapt to structural irregularities in the cover bore. A cage and cover sub-assembly and a paint roller incorporating the above is disclosed.

18 Claims, 2 Drawing Sheets

13
25
19
18
27
28
17
49
12
26
21
20
44
42
43
38
40
35
36
37
39
33
34
32
30
31
4
16
10
11
15
42aa
42a
42d
42b
42c
47
46
48
29

ROLLER HAVING SLIP-ON CAGE FOR PAINT ROLLER COVER

This application relates to a novel roller cage for a paint roller and, further, to a paint roller which includes said novel roller cage.

BACKGROUND OF THE INVENTION

Paint rollers have come into very widespread use due to their ability to apply coatings, usually paint, economically and quickly. Nearly every paint roller in commercial use today consists of a frame which terminates at one end in a handle and, at the other end in a cage and cover support rod, a cage received on the support rod, and a roller cover received on the cage. The term "roller" or "roller assembly" when used herein will be used to refer to the just described components, namely (1) a frame having a handle and a support rod, (2) a cage and (3) a roller cover.

The roller and the cage are almost always separable. This is so in order that the cover can be cleaned, or stored, possibly under water until the next use, or thrown away to make room for another cover. Thus the roller and the cage, at least, are assembleable and disassembleable components, and they form a sub-assembly of the roller assembly.

The operating requirements of the assembleable/disassembleable cage and roller subassembly of the roller are well defined and, to some extent, at cross purposes. Thus the cage must securely hold the cover during use so that the cover does not "walk off" the cage during use with obviously disastrous consequences, particularly if the cover has just been fully loaded with paint. However, at the same time, the securement between the cover and cage should not be so tight that separating the roller from the cage at the end of a session's use by the operator (i.e.: for cleaning, storage or discard) is difficult. In addition nearly all covers consist of an inner tube having a nominally constant bore, which receives the cage, and an outer surface to which the fabric is adhered which in turn receives and discharges paint. In many cases, due no doubt to the highly competitive nature of this product and thus the inability to provide highly-engineered components which always fit together perfectly, there is a looseness or play between the cover and the cage. The internal diameter of the bore may not be constant for example and thus the cage may not make contact with the bore in those areas in which the inside diameter of the bore goes oversize. By the same token the outside diameter of the cage structure may vary due to manufacturing variances, or damage while in use, and hence sections of the cage may make no contact, or only imperfect contact, with the cover so that the convenient removal of the cover from the cage cannot be achieved.

Further, many cages are structurally complex and hence both unduly expensive and unduly susceptible to improper functioning traceable to the complexity of the construction. Thus, for example, one widely sold roller includes a first cage element which is assembled to the free end of the support rod, the cage element including a plurality of radial fins which extend inwardly toward the center of the cover only a short distance from the free end, a second cage element which is assembled to the handle end of the cover and also includes a plurality of similar radial fins which extend inwardly from the handle only a short distance, and a third element consisting of a spacer which is located between the two opposed ends of the first and second elements, the only purpose of the spacer being to maintain the first and second elements in fixed, spaced relationship one to the other. The second element which is closest to the handle is often formed with a flange so as to preclude the cover from "walking" toward the handle. The first element cannot have such a flange of course or there would be no way to assemble the cover to the cage without running the risk of losing cage components, or improperly reassembling the cage. Thus it will be noted that this common cage construction includes three quite separate and differently contoured components and substantial assembly costs are incurred in assembling them to the cover both in terms of equipment needed and time required. In addition, should the three cage components come lose from the cover after the sub-assembly of the cover and the cage have been removed from the support rod, the reassembly of the cage components to the roller may be beyond the mechanical skill of many consumers-users. Should the spacer be lost for example and the cover with the two end elements reassembled to the support rod without it, subsequent failure is likely to occur because there is nothing to maintain the end elements in proper spaced relationship. The outer core element may for example creep inwardly during use and paint will of course build up in the space at the end of the tube which has been vacated by the first cage element. Should the user carelessly or intentionally permit the deposited paint to harden prior to the next use, the removal of the cover, as when it is worn, or the installation of a different cover with a different fabric nap to do a different painting task, may be nearly impossible for the average consumer-user.

A further shortcoming of most commercially available rollers is the high molding costs and the high assembly costs associated with fitting the cage and cover to the support rod using the current attachment methods such as crimping, washers, push nuts and other multi-piece attachment mechanisms.

SUMMARY OF THE INVENTION

The unique roller cage of this invention consists of a one-piece cage which can be quickly and simply snapped onto the cage and cover support rod of a roller handle whereby the cage is prevented from separating longitudinally from the handle, and onto which a cover may be easily assembled and easily disassembled, with the cover held tightly during use. Further, the cage is so constructed that it automatically adjusts to dimensional variations in the bore of the tube of the cover so that a gripping force exists between the cage and the tube at all locations without regard to dimensional variations which may exist in either or both of the cage and the tube. In addition, the cage is of one piece construction so that it can be economically molded and assembled to the support rod of the handle at a very low cost.

The invention further consists of the combination of a handle and the roller cage as above described, the handle being constructed to receive the cage by a snap fit which, as mentioned, precludes longitudinal displacement of the cage and its associated cover from the handle during use, yet which permits easy disassembly of the cage and cover sub-assembly when a cover change is required.

The foregoing is preferably achieved by forming the cage as a one-piece plastic or thermal plastic rubber member with a snap fit collar adapted to cooperate with a collar ring in the support rod and a plurality of projections which are deformed by the tube as the cover is attached to the cage in a direction to exert a resisting force to the separation of the cover from the cage under normal working stresses. The projections may be either a plurality of rings or teeth arranged in a generally radial pattern, or the projections may be arranged in a generally longitudinal pattern with respect to the axis of the cage. In either event the projections are constructed to be deformed at their extremities whereby they come into contact with the tube of the cover so as to generate a frictional resisting force to the separation of the cover from the cage during use.

BRIEF DESCRIPTION OF THE DRAWING

The invention is illustrated more or less diagrammatically in the accompanying drawing wherein.

DESCRIPTION OF THE DRAWING

Figures 1, 2, 3, 4, 5:
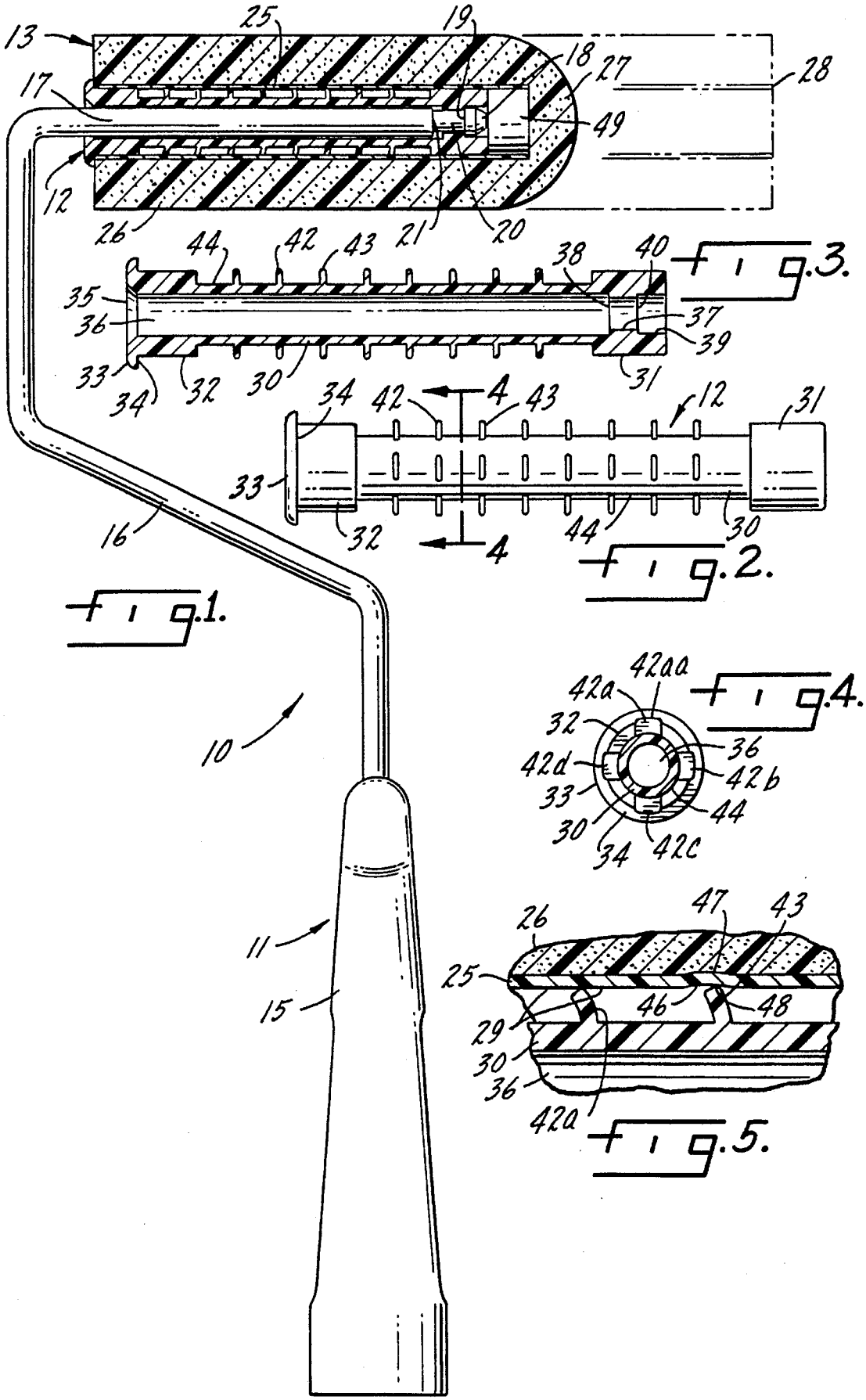
FIG. 1 is a plan view with parts in section of a paint roller having the unique cage of this invention, the roller being contoured to be assembled in cooperating relationship with the cage.
FIG. 2 is a plan view of the cage of the invention to an enlarged scale as contrasted to FIG. 1.
FIG. 3 is a longitudinal section view of the cage.
FIG. 4 is a section view taken substantially along the line 4—4 of FIG. 2.
FIG. 5 is a partial, detail view showing the cooperative relationship between the projections on the cage and the tube of the cover to yet a further enlarged scale as shown in FIG. 1.
Figure 6:
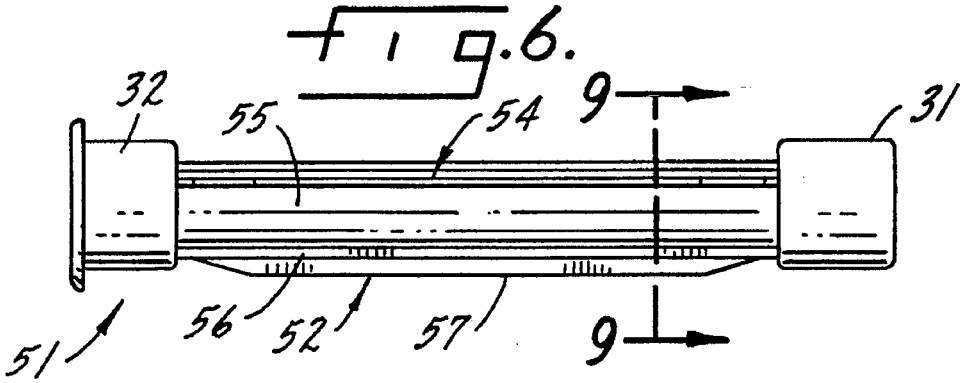
FIG. 6 is a plan view of an alternative embodiment of cage usable with the handle shown in FIG. 1.
Figure 8:
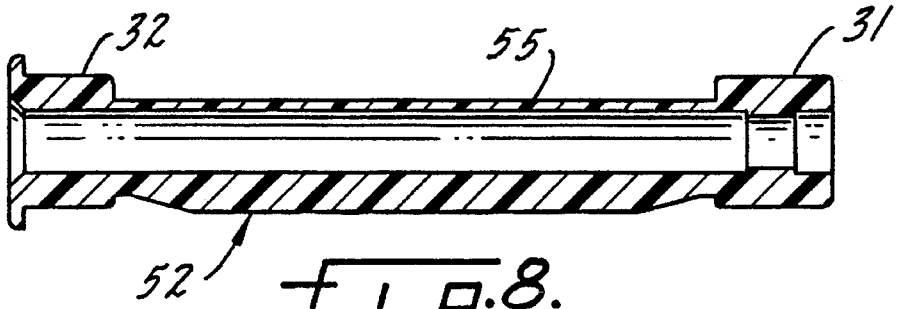
FIG. 8 is a longitudinal section taken substantially along the line 8—8 of FIG. 7.
Figure 7:
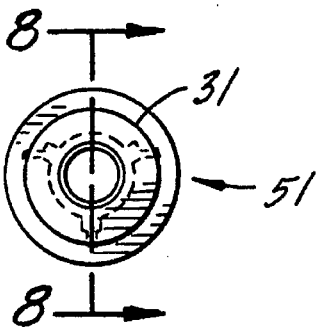
FIG. 7 is a right-end view of the cage shown on FIG. 6.

Like reference numerals will be used to refer to like or similar parts from FIG. 1 to FIG. 9 throughout the following description of the drawing.

Referring first to FIG. 1 a roller is indicated generally at 10. The roller consists in this instance of three main components, a handle, indicated generally at 11, a roller cage, indicated generally at 12 and a cover, indicated generally at 13.

The handle 11 includes a hand grip 15, an extension section 16 which has an offset configuration, and a cage and roller support rod 17. The extremity of the support rod 17 is formed in a bullet shape 18 which terminates at its rear in a shoulder 19. A necked-down portion forms a collar ring 20, the collar ring 20 being of a smaller diameter than the diameter of the support rod 17 so that a shoulder is formed at 21.

The cover 13 consists essentially of an inner tube 25 which is preferably formed from a suitable plastic such as polypropylene. Other flexible materials include polyethylene, nylon and thermal plastic rubber. The inside diameter of the tube is nominally constant from end to end of the tube but it will be understood that, in view of the materials and mass production methods used in manufacture, the inside diameter may vary slightly from location to location as will be amplified hereinafter. A cover is indicated at 26, the cover being secured to and surrounding tube 25. In this instance a foam cover having a continuous, closed end 27 is shown. It will be appreciated however that a conventional pile fabric cover, which is open at the ends as indicated at 28 in the dotted line extension of the right end of the cover 26, may equally as well be used.

The cage 12 is illustrated in assembled condition with a handle 11 and cover 13 to form a complete roller in FIG. 1. However, the features of the cage can be best appreciated from the showings in FIGS. 2–5 which are shown to a larger scale than FIG. 1.

The cage 12 includes a barrel portion 30 which terminates at its right, or outer, end in an enlargement 31 and at its left, or inner, end in another enlargement 32. The left end of enlargement 32 terminates in a flange 33 having an outwardly facing flange shoulder 34. It will be noted that the outside diameter of enlargement portions 31 and 32 are of equal diameter and of a size to be snugly received within tube 25. The flange 33 however extends outwardly beyond the outside diameter of tube 25 so that the left end of tube 25 butts against flange shoulder 34 in the assembled condition of FIG. 1.

A constant diameter bore 36 extends from the chamfered end of the barrel to, in this instance, a location just within the enlargement 31. The diameter of the bore is sufficient to freely receive the support rod 17 without binding, yet without appreciable looseness, so the cage and cover sub-assembly are able to rotate about the support 17 which is non-rotatable. The right end of the bore 36 opens into a necked down portion 37 of reduced diameter, the left end of necked down portion 37 forming an abutment shoulder 38 which extends radially inwardly a distance sufficient to engage collar ring shoulder 21 of rod 17 should the cage and cover sub-assembly move to the left with respect to the support rod 17. The outer end of the necked down portion 37 opens into an end bore 39 having a diameter larger than the diameter of the bore in necked down portion 37, thereby forming an annular shoulder 40. It will be understood that since the diameter of the base of the bullet nose 18 of rod 17 is larger than the diameter of the bore in necked down portion 37, rod shoulder 19 will butt against annular shoulder 40 when the cage and cover sub-assembly move to the right with respect to rod 17; see the FIG. 1 position.

A plurality of projections 42, 43 extend generally radially outwardly from the outside surface 44 of barrel 30. In this instance the projections are arranged in rows lying in vertical planes passing through the axis of the cage, and, further, there are 4 projections per row as indicated at 42*a*, 42*b*, 42*c* and 42*d* in FIG. 4. As can be best seen in FIG. 4, the outer curved edges, one of which is seen at 42*aa*, when in a relaxed, disassembled condition, project outwardly from barrel 30 a distance slightly greater than the outside surface of enlargement 32, as best seen in FIG. 4, and hence outwardly a radial distance slightly greater than the inside diameter radius of tube 25.

When the cage is assembled to a cover as shown in FIGS. 1 and 5 the relationship between the projections 42, 43, the barrel 30, and tube 25 are altered. Referring primarily to FIG. 5 it will be noted that when a projection, such as 42*a*, is located opposite a section of the tube 25 which has a constant diameter, as at 29, the projection or fin 42*a* is bent to the left so that pressure is exerted between the projection 42*a* and the tube 25 which results in frictional resistance against movement in either direction of tube 25 with respect to projection 42*a*, but more so with respect to movement of tube 25 to the right with respect to barrel 30 and projection 42*a*.

As mentioned, the bore of the tube 25, though intended to be of constant internal diameter, is not always constant from location to location due to various factors including manufacturing tolerances, etc. In the area indicated at 46 it will be seen that a slight outward bulge 47 appears in tube 25 resulting in an increase in the inside diameter of the tube 25 at that location, and the bulge is formed at the precise location where projection 43 makes contact with the inside surface 48 of tube 25. In this instance, the projection 43 still makes contact with surface 48 since the depth of the bulge does not extend outwardly beyond the relaxed extreme outer edge, represented at 42*aa*, of projection 43. The projection 43, while making contact with the tube 25, is under less deflection tension than projection 42*a*, and hence a lower frictional resistance exists between projection 43 and tube 25 than exists projection 42*a* and tube 25. Thus, even though the contour of the bore in tube 25 varies from location to location along its length, the projections on the barrel portion of the cage adapt themselves to such variations so that some pressure, and hence frictional resistance to longitudinal separation, exists at all contact points between the projections and the tube 25.

It will be noted that in the solid line position of FIG. 1 a plug 49 is anchored in the outer end of tube 25 as by friction or sonic welding. In the dotted line position of FIG. 1 the closed end portion 27 of the cover has been eliminated. This construction will be particularly advantageous in connection with use of a conventional fabric cover which does not include a closed end.

Referring now to FIGS. 6 through 9 it will be noted that cage 51 has longitudinal projections 52, 53, 54 instead of vertical or lateral projections 42, 43.

Figure 9:
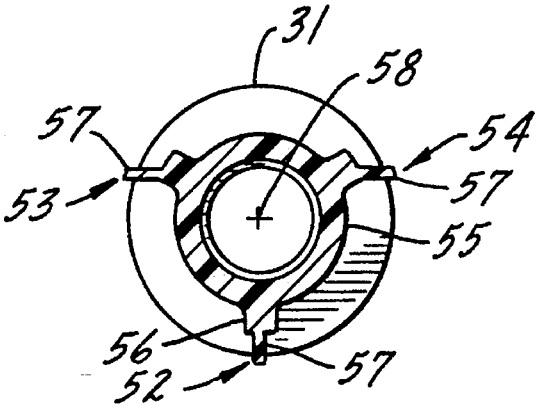
FIG. 9 is a section taken substantially along the line 9—9 of FIG. 6 to an enlarged scale.

Cage 51 includes a barrel portion 55 which terminates at its outer end in enlargement 31 and at its inner end in enlargement 32. From FIG. 9 it will be noted that each of longitudinal projections 52, 53 and 54 include a base portion 56 and a fin 57 extending outwardly from an associated base 56. The fin 57 extends radially outwardly to a point which is located a greater radial distance from the axis 58 than the surface of enlargement 31, and hence the inside surface of tube 25, all as best seen in FIG. 9. The fins 57 are sufficiently thin and flexible to be bent over as a tube 25 is fitted over cage 51, the ends of the bent over or deflected portions 57 of longitudinal projections 52, 53 and 54 thereby making pressure contact with the inside surface of the tube 25. As before, the pressure exerted between the fins 57 of longitudinal projections 52, 53, 54 and the tube 25 will create a substantial frictional resistance to relative movement between the cage and tube, and hence the tube and cover will not walk off the cage. It will also be noted that the fins or tips 57 of the projections 52–54 are sufficiently thin and flexible that contact will be made at all locations between the tube and fins, the fins 57 being deformed to a greater or lesser extent from location to location along the cage to accommodate variations in the contour of the inside of the tube.

It will be understood that variations and modifications may be made within the spirit and scope of the invention. For example, the enlargements 31, 32 may be of a greater or lesser longitudinal dimension than that shown, it being only essential that the projections, in a longitudinal direction, be co-extensive with the tube over a substantial portion of the span of both. Accordingly, the scope of the invention should not be limited by the foregoing exemplary description but solely by the scope of the appended claims where interpreted in light of the relevant prior art.

We claim:

1. A cage for a paint cover of the type having a central bore of a nominally uniform internal diameter over at least a substantial portion of the co-extensive span of the cage and cover, said cage including an elongated barrel portion having an exterior surface extending about the periphery thereof and between opposite ends thereof and further wherein the barrel portion has an interior surface extending along the length thereof which is adapted to receive a roller support rod, and a plurality of projections extending radially outwardly from the exterior surface of the barrel portion, said barrel portion and all of said plurality of projections being formed as a single piece with no discontinuities located between the exterior surface and the interior surface along substantially the entire length of the barrel portion, at least one of said projections extending radially outwardly a distance greater than the radial distance of the inside surface of a bore in a cover in which the cage is to be received, said at least one of said projections being composed of a flexible material and being sufficiently thin as to be deflectable at its outer end portion to a degree sufficient to enable the cage to be snugly received within the bore in the cover, whereby said at least one of said projections makes pressure contact with the bore in said cover to thereby create frictional resistance to movement between the cage and the bore said cage being of a single, unitary construction.

2. The cage of claim 1 further characterized in that all of said projections are constructed to make pressure contact with the bore of the cover.

3. The cage of claim 2 further characterized in that the projections are arranged in a circular pattern around the barrel portion.

4. The cage of claim 3 further characterized in that the projections are composed of a plurality of individual projections, each individual projection being arranged to make separate contact with the bore in the cover, said projections being located in a generally circular path around the barrel portion.

5. The cage of claim 2 further characterized in that the projections are arranged in a longitudinal pattern along the barrel portion.

6. The cage of claim 1 further characterized in that the cage is composed of a material selected from the group consisting of thermal plastic and thermal plastic rubber materials.

7. A cage and cover sub-assembly for a roller upon which said sub-assembly is arranged to be mounted, said sub-assembly including, a cover, said cover having a central bore adapted to receive a cage in snug, close fitting relationship whereby said cover and cage form a sub-assembly of components which, in use, do not move with respect to one another, a cage, said cage having an elongated barrel portion having an exterior surface extending about the periphery thereof and between opposite ends thereof and further wherein the barrel portion has an interior surface extending along the length thereof which is adapted to receive a roller support rod, and a plurality of projections extending radially outwardly from the exterior surface of the barrel portion, said barrel portion and all of said plurality of projections being formed as a single piece with no discontinuities located between the exterior surface and the interior surface along substantially the entire length of the barrel portion, at least one of said projections extending radially outwardly a distance greater than the radial distance of the inside surface of the bore in the cover in which the cage is received, said at least one of said projections being composed of flexible material and being sufficiently thin as to be deflectable at its outer end portion to a degree sufficient to enable the cage to be snugly received within the bore in the cover, whereby said at least one of said projections makes pressure contact with the bore in said cover to thereby create frictional resistance to movement between the cage and the bore, said cage being of a single, unitary construction.

8. The cage and cover sub-assembly of claim 7 further characterized in that all of said projections are constructed to make pressure contact with the bore of the cover.

9. The cage and cover sub-assembly of claim 8 further characterized in that the projections are arranged in a circular pattern around the barrel portion.

10. The cage and cover sub-assembly of claim 9 further characterized in that the projections are comprised of a plurality of individual projections, each individual projection being arranged to make separate contact with the bore in the cover, said projections being located in a generally circular path around the barrel portion.

11. The cage and cover sub-assembly of claim 8 further characterized in that the projections are arranged in a longitudinal pattern along the barrel portion.

12. The cage and cover sub-assembly of claim 7 further characterized in that the cage is composed of a material selected from the group consisting of thermal plastic and thermal plastic rubber materials.

13. A paint roller, said roller including a handle, said handle having a hand grip portion which is attached to a cover support rod, and a cage and cover sub-assembly constructed and arranged to be received on said cover support rod, said cage and cover sub-assembly including a cover, said cover having a central bore adapted to receive a cage in snug, close fitting relationship whereby said cover and cage form a sub-assembly of components which, in use, do not move with respect to one another, a cage, said cage having an elongated barrel portion having an exterior surface extending about the periphery thereof and between opposite ends thereof and further wherein the barrel position has an interior surface extending along the length thereof which is adapted to receive the cover support rod, and a plurality of projections extending radially outwardly from the exterior surface of the barrel portion, said barrel portion and all of said plurality of projections being formed as a single piece with no discontinuities located between the exterior surface and the interior surface along substantially the entire length of the barrel portion, at least one of said projections extending radially outwardly a distance greater than the radial distance of the inside surface of the bore in the cover in which the cage is received, said at least one of said projections being composed of a flexible material and being sufficiently thin as to be deflectable at its outer end portion to a degree sufficient to enable the cage to be snugly received within the central bore in the cover, whereby said at least one of said projections makes pressure contact with the bore in said cover to thereby create frictional resistance to movement between the cage and the bore, said cage being of a single, unitary construction.

14. The paint roller of claim 13 further characterized in that all of said projections are constructed to make pressure contact with the bore of the cover.

15. The paint roller of claim 14 further characterized in that the projections are arranged in a circular pattern around the barrel portion.

16. The paint roller of claim 15 further characterized in that the projections are comprised of a plurality of individual projections, each individual projection being arranged to make separate contact with the bore in the cover, said projections being located in a generally circular path around the barrel portion.

17. The paint roller of claim 13 further characterized in that the projections are arranged in a longitudinal pattern along the barrel portion.

18. The paint roller of claim 17 further characterized in that the cage is composed of a material selected from the group consisting of thermal plastic and thermal plastic rubber materials.

* * * * *